US008662267B1

(12) United States Patent
Hart et al.

(10) Patent No.: US 8,662,267 B1
(45) Date of Patent: Mar. 4, 2014

(54) LUGGAGE FOR TRANSPORTING CHILDREN

(75) Inventors: Cristyn Danielle Hart, Huntsville, AL (US); John Kraljic, Coram, NY (US)

(73) Assignee: Cristyn Danielle Hart, Huntsville, AL (US)

( * ) Notice: Subject to any disclaimer, the term of this patent is extended or adjusted under 35 U.S.C. 154(b) by 417 days.

(21) Appl. No.: 12/817,621

(22) Filed: Jun. 17, 2010

Related U.S. Application Data

(60) Provisional application No. 61/301,397, filed on Feb. 4, 2010, provisional application No. 61/347,204, filed on May 21, 2010.

(51) Int. Cl.
*A63B 69/36* (2006.01)

(52) U.S. Cl.
USPC ..... 190/8; 190/1; 190/18 A; 280/30; 280/47.25; 280/643; 297/217.1; 297/250.1; 301/111

(58) Field of Classification Search
USPC ..... 190/1, 8, 18 A; 280/30, 47.25, 643; 297/217.1, 250.1
See application file for complete search history.

(56) References Cited

U.S. PATENT DOCUMENTS 4,367,829 A * 1/1983 Kusz ..... 224/415
5,295,565 A 3/1994 Latshaw
5,303,805 A * 4/1994 Hauser ..... 190/18 A
5,482,147 A 1/1996 Wang
5,547,052 A 8/1996 Latshaw
5,573,155 A * 11/1996 Sadler ..... 224/155
5,988,657 A * 11/1999 Henkel ..... 280/47.25
6,186,295 B1 2/2001 Lin et al.
6,644,447 B2 * 11/2003 Pohl ..... 190/8
7,350,857 B2 * 4/2008 Bishop ..... 297/129
7,987,955 B2 * 8/2011 Puchalski ..... 190/18 A
2007/0089952 A1 * 4/2007 Herbst et al. ..... 190/8

* cited by examiner

*Primary Examiner* — Anthony Stashick
*Assistant Examiner* — Cynthia Collado
(74) *Attorney, Agent, or Firm* — Maynard, Cooper & Gale, P.C.; Jon E. Holland

(57) ABSTRACT

The present disclosure generally pertains to articles of luggage that are integrated with child seats so that children may sit on the luggage articles during transport. In one exemplary embodiment, an article of luggage, such as a suitcase, has a retractable seat and a plurality of wheels. The retractable seat resides within a cavity in the luggage article when positioned in a retracted position. A user can pull the retractable seat from the cavity to position a seat back in an extended position. While in the extended position, a child can sit on the article of luggage and lean back against a back of the seat. The back of the seat or other component of the article of luggage can be pulled or pushed such that at least one wheel of the article of luggage rolls on a surface in order to move the article from one location to another. After moving the article of luggage in such manner, a user can push the retractable seat to return it into the seat cavity thereby retracting the seat back into the retracted position for storage.

21 Claims, 18 Drawing Sheets

LUGGAGE FOR TRANSPORTING CHILDREN

CROSS REFERENCE TO RELATED APPLICATION

This application claims priority to U.S. Patent Application No. 61/301,397, entitled "Luggage Having a Retractable Seat Integrated with a Child Seat," and filed on Feb. 4, 2010, which is incorporated herein by reference. This application also claims priority to U.S. Provisional Patent Application No. 61/347,204, entitled "Luggage for Transporting Children," and filed on May 21, 2010, which is incorporated herein by reference.

RELATED ART

Traveling with luggage, such as a suitcase, can be burdensome and problematic. Indeed, while traveling, a user may attempt to carry several items at once, including one or more articles of luggage, making it difficult to navigate through crowded areas, such as airports or shops. Further, in some instances, the user may be traveling with and responsible for a child. In some cases, the user may carry the child thereby adding to the burdens of the user while he or she is attempting to carry or otherwise transport other items. At other times, the child may walk with the user while he or she is attempting to carry or otherwise transport items, such as luggage. In such case, the user may become distracted with the tasks of carrying items and/or traveling, making it difficult to keep track of the child and increasing the likelihood that the child may become separated from the user or wander off without the user's notice. Moreover, techniques for assisting users in traveling and keeping track of children while traveling, such as while carrying articles of luggage through an airport or other crowded venue, are generally desired.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure generally pertains to articles of luggage that are integrated with child seats so that children may sit on the luggage articles during transport. In one exemplary embodiment, an article of luggage, such as a suitcase, has a retractable seat and a plurality of wheels. The retractable seat resides within a cavity, referred to herein as "seat cavity," in the luggage article when positioned in a retracted position. A user can pull the retractable seat from the seat cavity to position a seat back in an extended position. While in the extended position, the seat back or other component of the article of luggage can be pulled or pushed such that at least one wheel of the article of luggage rolls on a floor surface in order to move the article from one location to another. After moving the article of luggage in such manner, a user can push the retractable seat to return it into the seat cavity thereby retracting it back into the retracted position for storage.

In one exemplary embodiment, a seat bottom is attached to the seat back. When the seat back is positioned in the extended position, the seat bottom rests on a side of the luggage article. As the article is being pulled or pushed by a user such that at least one wheel of the article rolls on a floor surface, a child may sit on the seat bottom. At least one strap is secured around the child in order to help secure the child to the article and prevent the child from falling. Thus, the process of moving the luggage article while tending to a small child can be facilitated.

In one exemplary embodiment, the seat bottom is attached to the seat back such that the seat bottom is pivoted as the seat back is retracted into the seat cavity. As an example, the seat bottom may be rotated about 90 degrees and contact the seat back so that it is aligned for insertion into the seat cavity. Continued retraction of the seat into the seat cavity moves the seat back and seat bottom into the seat cavity such that when the seat back is fully retracted, both the seat back and the seat bottom are fully contained within the seat cavity. When the seat back is later pulled from the seat cavity to position it in the extended position, the motion of the seat back pulls the seat bottom from the seat cavity. As the child seat is pulled from the seat cavity, gravity causes the seat bottom to pivot such that it contacts and rests against a side of the luggage article.

Figure 1:
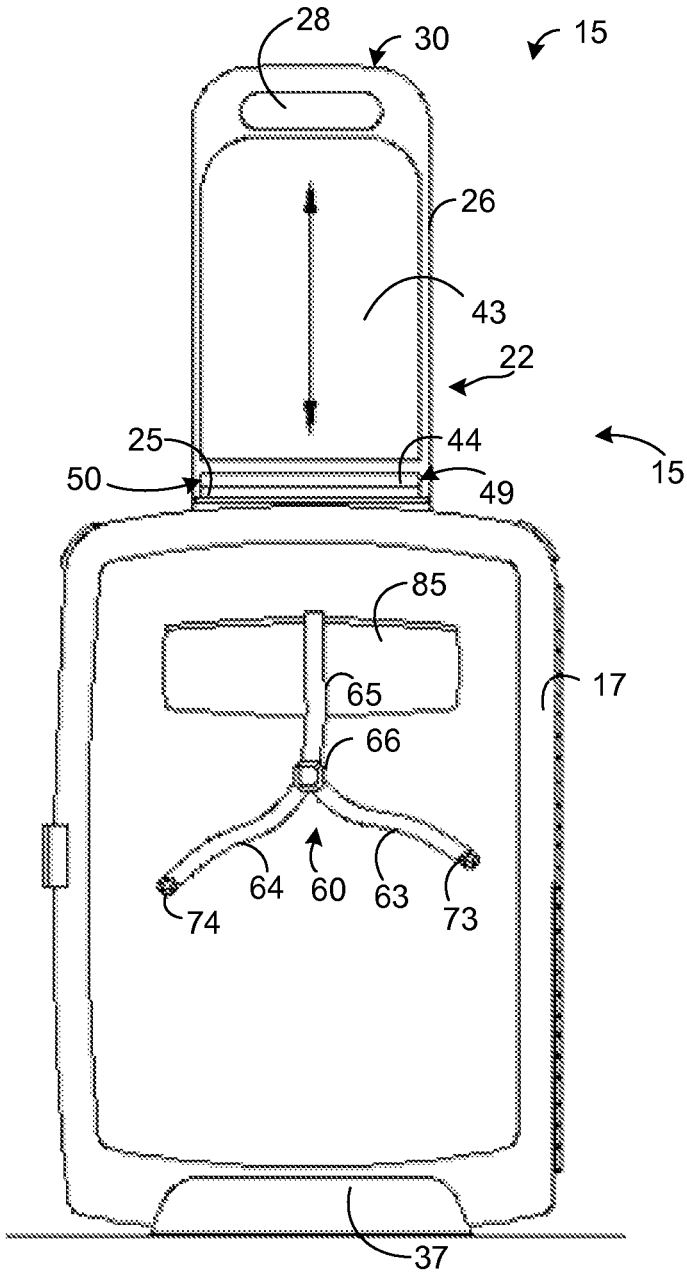
FIG. 1 depicts a front view of an exemplary embodiment of an article of luggage having a seat back in an extended position.
Figure 2:
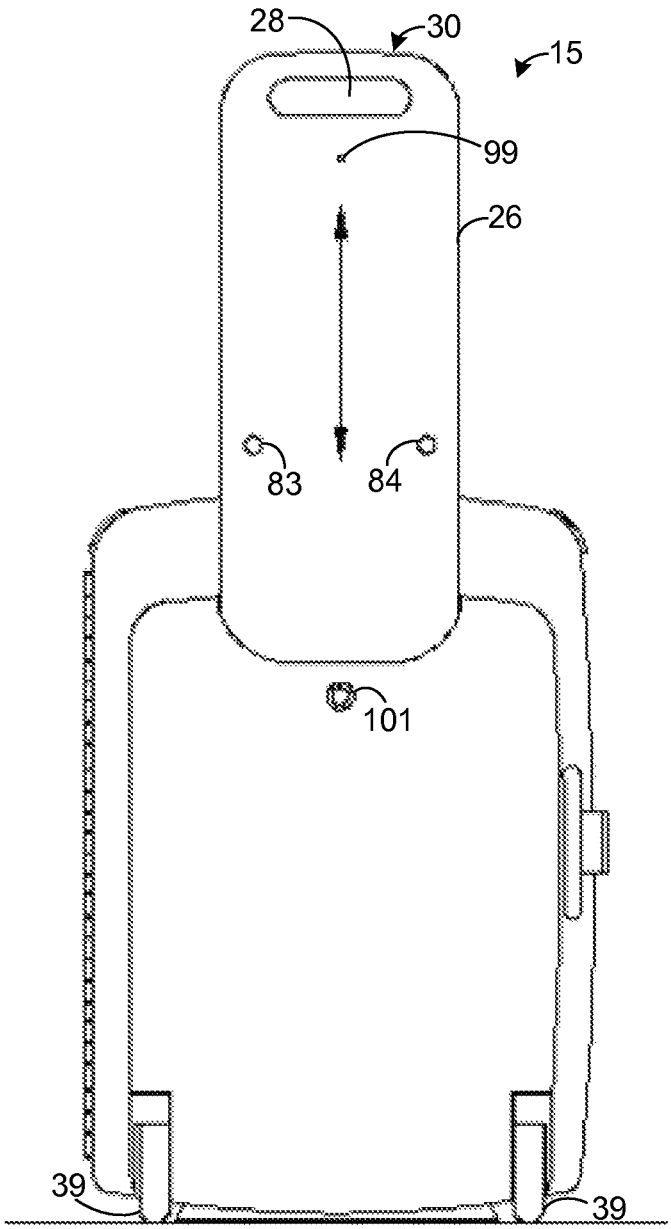
FIG. 2 depicts a back view of the article of luggage depicted in FIG. 1.
Figure 3:
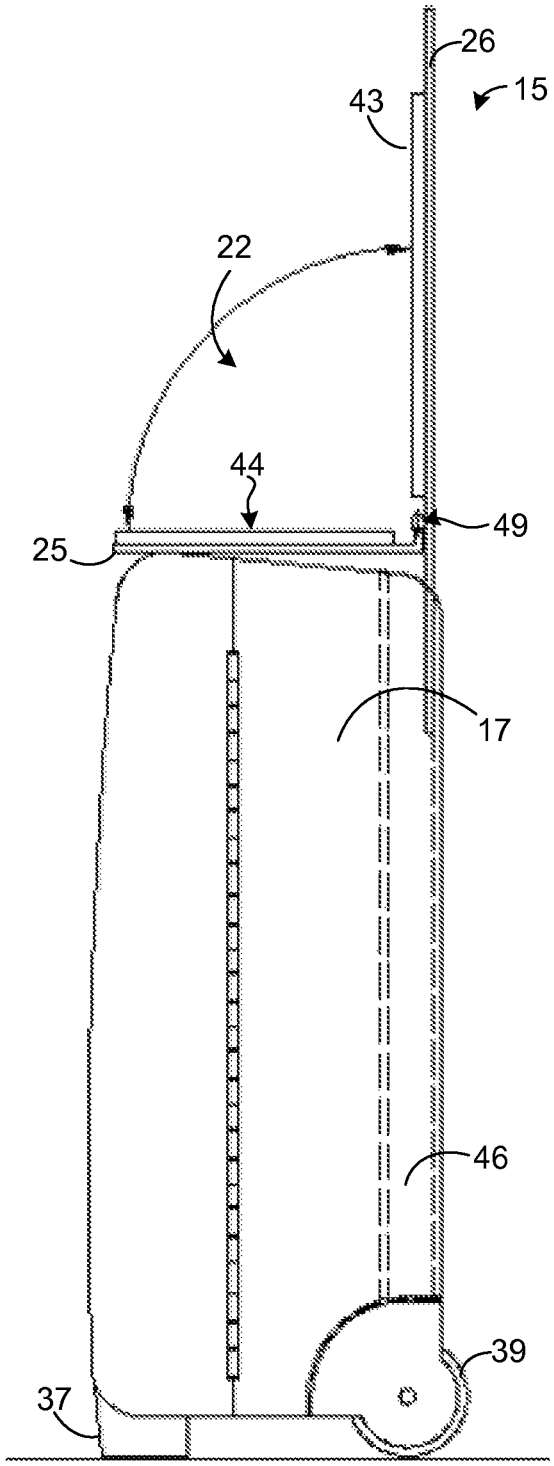
FIG. 3 depicts a side view of the article of luggage depicted in FIG. 1.

FIGS. 1-3 show an exemplary embodiment of an article 15 of luggage having a retractable seat 22, which is shown in the extended position. The luggage article 15 has a luggage case 17 for storing items, such as clothing, bathroom supplies, etc., for transport. The article 15 may be carry-on luggage (i.e., luggage to be carried on board commercial aircraft) or other types of luggage. The seat 22 has a seat bottom 25 and a seat back 26. The seat back 26 is coupled to the seat bottom 25 and has a hole 28 thereby forming a handle 30 at an end of the seat back 26. The handle 30 can be grasped by a user to pull the seat 22 from a retracted position to the extended position shown by FIG. 1, as will be described in more detail hereafter. The user can also grasp the handle 30 while the seat back 26 is in the extended position in order to pull or push the article 15 to a desired location.

Figure 4:
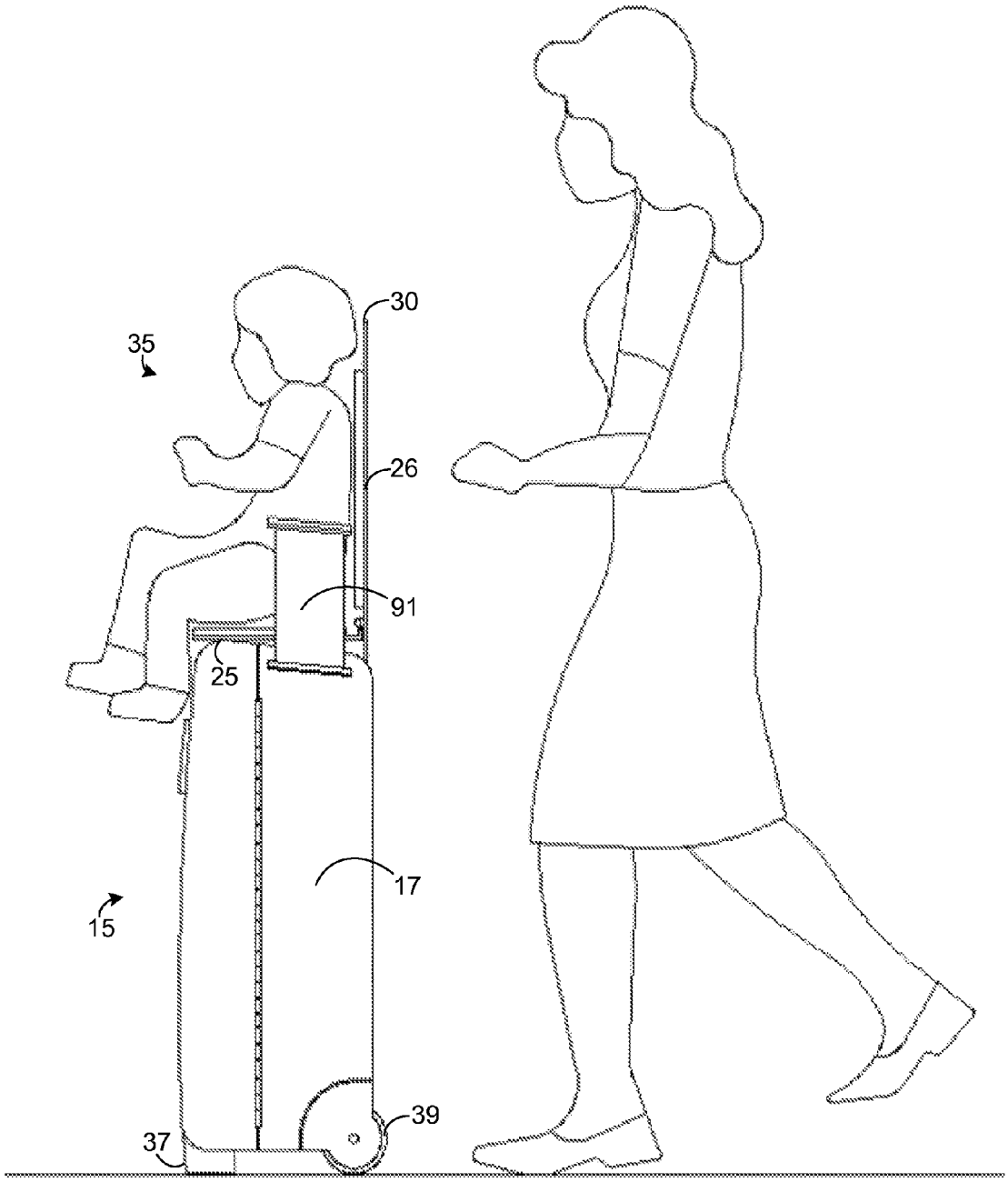
FIG. 4 depicts a side view of the article of luggage depicted in FIG. 1 while the article is in an upright position with a child sitting on the article.
Figure 5:
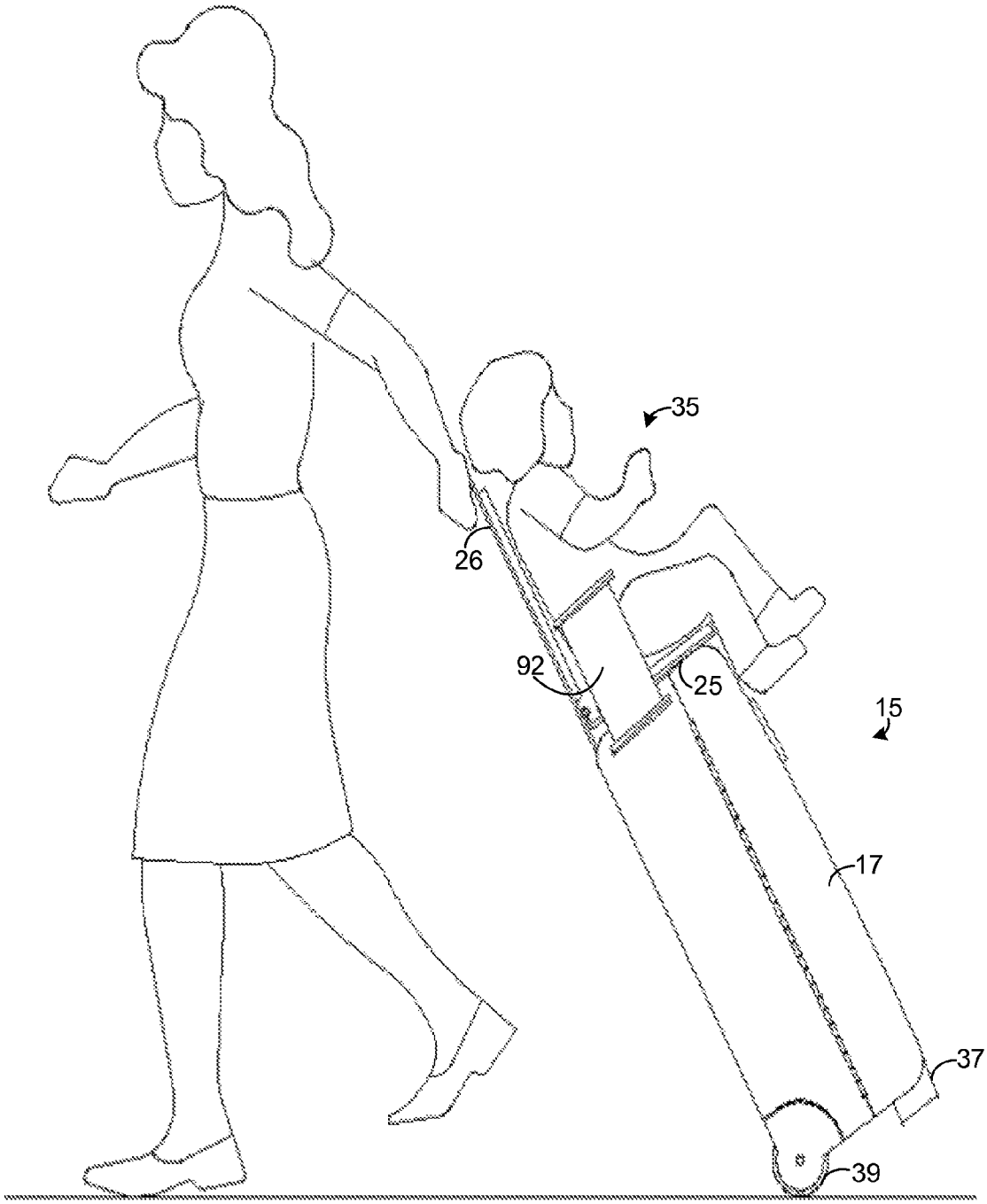
FIG. 5 depicts a side view of the article of luggage depicted in FIG. 4 as wheels of the article are being rolled across a floor surface by a user.

As shown by FIG. 4, a child 35 may be positioned on the seat 22 such that the child 35 sits on the seat bottom 25 and leans his or her back against the seat back 26. A stop 37 on the bottom of the article 15 helps to stabilize the article 15 and keep the sitting area level for the child 35. Although the stop 37 helps to stabilize the article 15, it may be desirable for a user to not leave the child 35 unattended on the article 15 to further assist in preventing the child 35 from falling or the article 15 from tipping. The seat bottom 25 is pushed against a side of the luggage case 17 by the child 35, and the luggage case 17 provides support to the seat bottom 25. As shown by FIG. 5, a user may grasp the handle 30 and simultaneously transport both the child 35 and the article 15 while the child 35 is sitting on the seat 22. For example, the user may push or pull on the handle 30 causing the wheels 39 of the article 15 to roll on a floor surface (e.g., ground) while the child 35 is sitting on the seat 22.

In one exemplary embodiment, the seat back 26 has a pad 43 that provides a cushion for the child's back while the child 35 is sitting on the seat 22. The seat bottom 25 has a pad 44 that provides a cushion for the child's bottom while the child 35 is sitting on the seat 22. The use of the pads 43, 44 are unnecessary, and the child 35 may sit on the seat 22 without the pads 43, 44 if desired.

In one exemplary embodiment, when the seat 22 is pulled to the extended position, as shown by FIG. 1, the seat back 26 is locked in such position by a locking mechanism (not shown) until the locking mechanism is activated by the user to allow the seat back 26 to move toward the retracted position. Many conventional locking mechanisms are well-known and may be used to lock the seat back 26 in the extended position. As an example, locking mechanisms commonly used to lock retractable handles of conventional suitcases may be used to lock the seat back 26. Further, use of a locking mechanism for the seat 22 is unnecessary and may be omitted if desired. In this regard, pulling on the handle 30 to move the article 15 helps to keep the seat back 26 in the extended position. Further, the presence of the child 35 in the seat 22 helps to prevent the seat 22, including the seat back 26, from moving to the retracted position.

Figure 6:
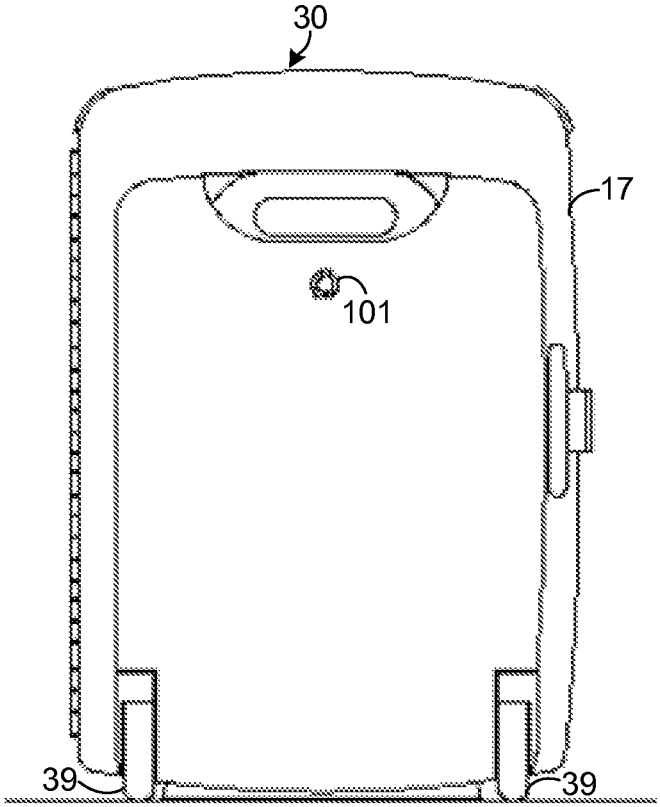
FIG. 6 depicts a back view of the article of luggage depicted in FIG. 2 after the seat back has been moved to a retracted position.
Figure 7:
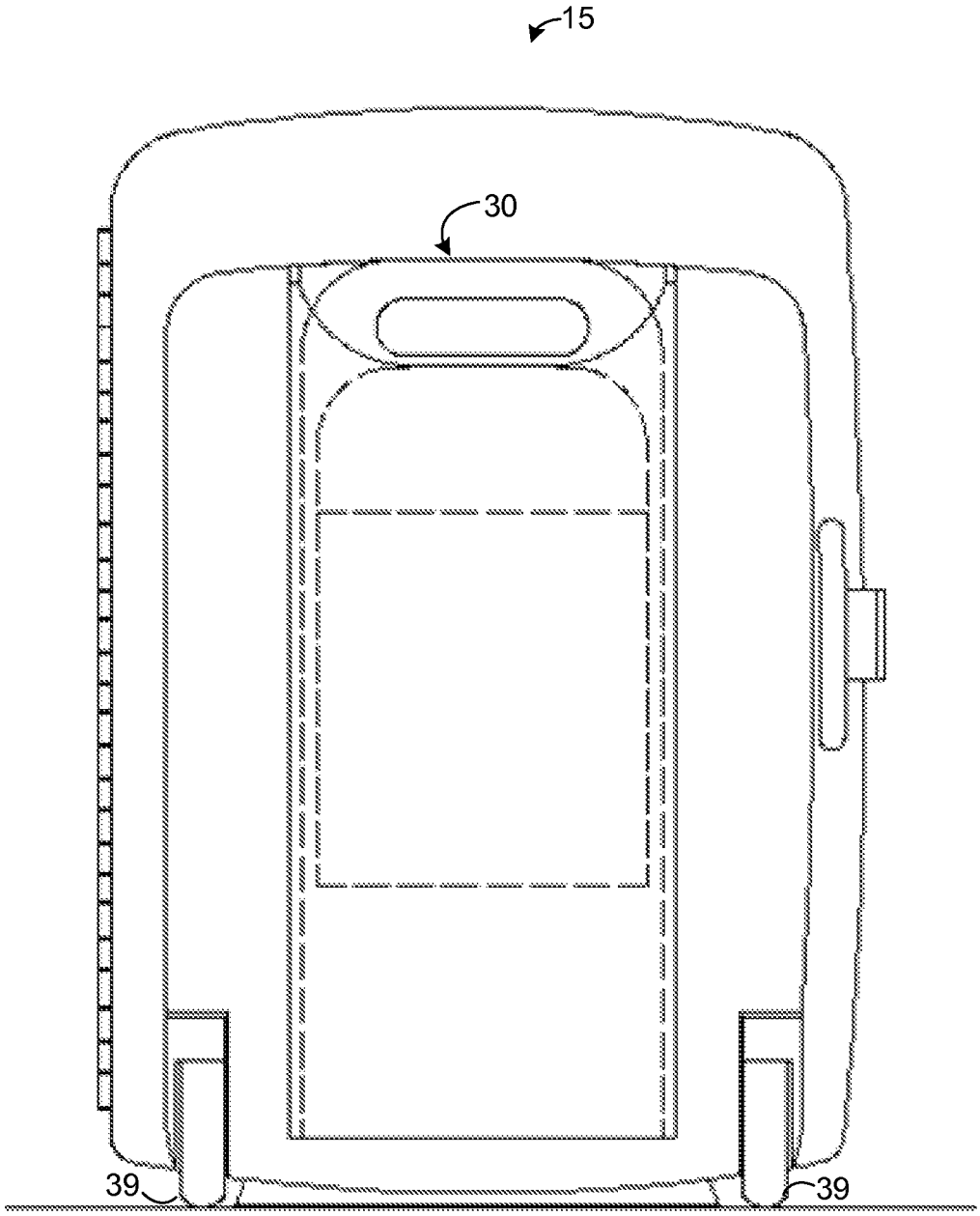
FIG. 7 depicts a front view of the article of luggage depicted in FIG. 6.

As shown by FIG. 3, the article 15 has a seat cavity 46 (marked by dotted lines) into which the seat 22, including both the seat bottom 25 and the seat back 26, can be pushed to move the seat 22 from the extended position to the retracted position. FIGS. 6 and 7 show the seat 22 fully retracted to such position. Moving the seat 22 to the retracted position reduces the overall size of the article 15 making it more suitable for storage or transport under some conditions, such as when the article 15 is loaded into a vehicle or otherwise not being rolled on the wheels 39. As a mere example, when the seat 22 is moved to the retracted position, the overall size of the article 15 may be small enough to be carried on board commercial aircraft, but other sizes of the article 15 are possible in other embodiments. As known in the art, airline rules or regulations require the size of luggage permitted to be carried on board aircraft to be limited. At least one airline currently requires the dimensions of carry-on luggage to be less than 45 linear inches in combined width, length, and height (i.e., the sum of length, width, and height must be less than 45 inches), and the size of the article 15 in at least one embodiment meets such requirements in at least one embodiment. However, the size of the article 15 may be different in other embodiments, and it is unnecessary for the article 15 to comply with the size requirements for carry-on luggage.

Figure 8A:
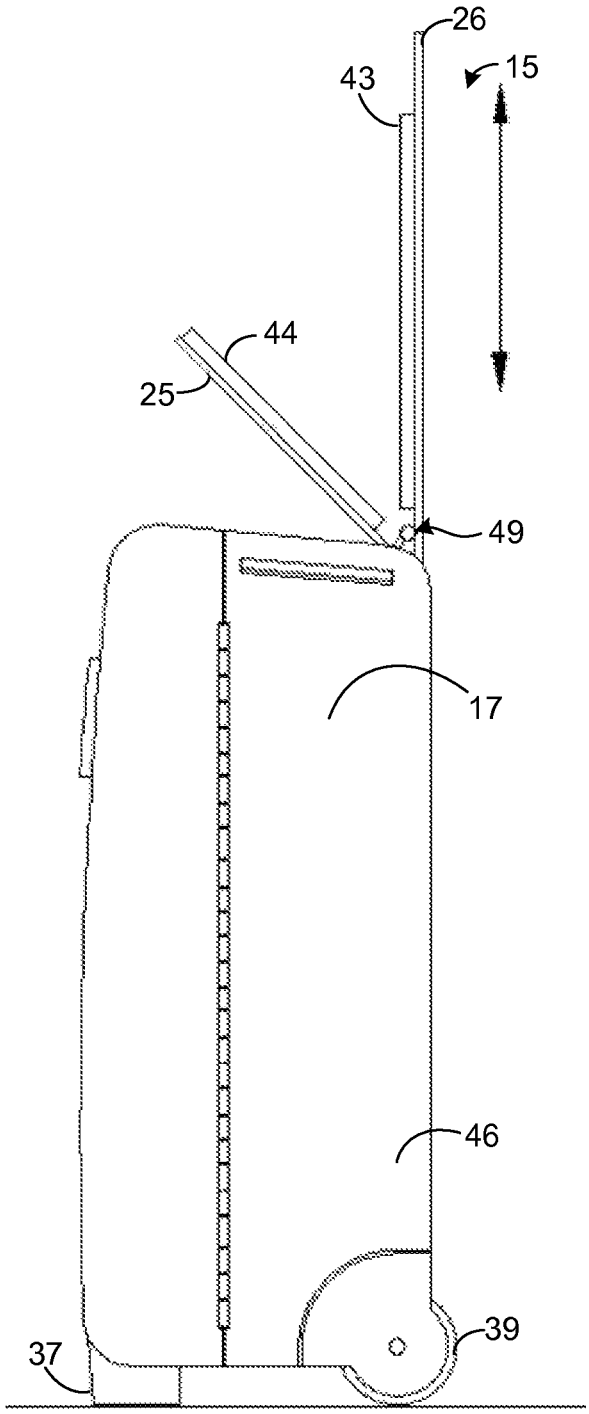
FIGS. 8A and 8B depict a side view of the article of luggage depicted in FIG. 3 as the seat back is moved from an extended position toward a retracted position.
Figure 8B:
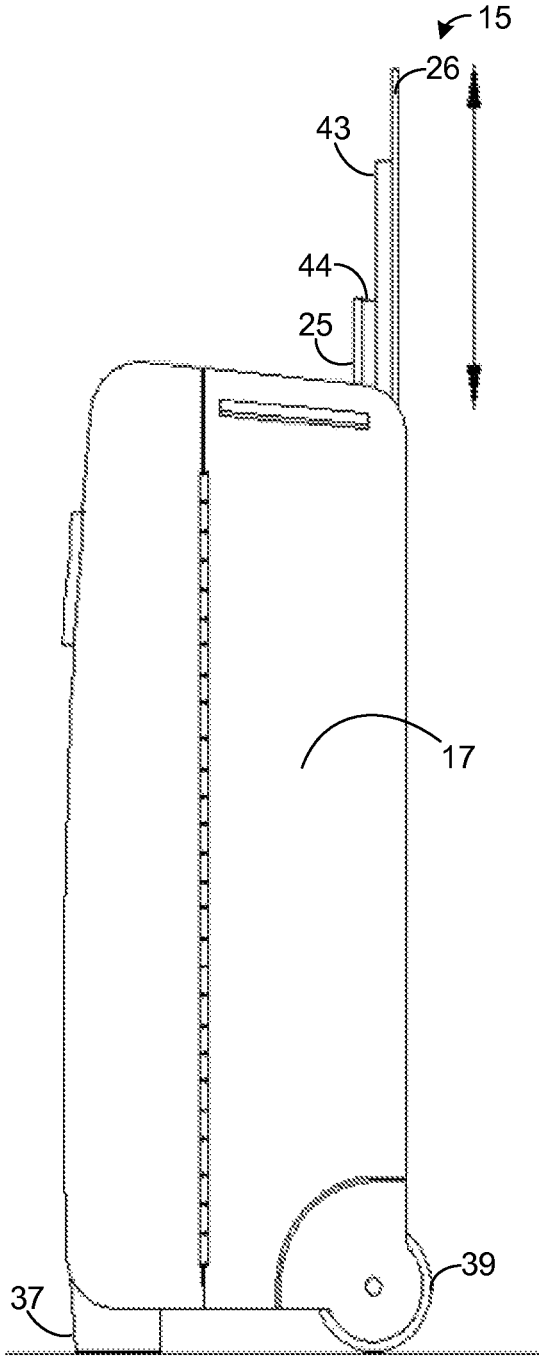

The seat bottom 25 is pivotally coupled to the seat back 26 at pivot points 49, 50. As the seat back 26 is pushed into the seat cavity 46 (while moving from the extended position to the retracted position), the motion of the seat back 26 lowers the pivot points 49, 50 toward the seat cavity 46 causing the luggage case 17 to press against the seat bottom 25 with sufficient force to cause the seat bottom 25 to pivot about the points 49, 50, as shown by FIG. 8A. The seat bottom 25 rotates about 90 degrees as the seat back 26 is pushed further into the seat cavity 46 until the pads 43, 44 contact each other, as shown by FIG. 8B. As pushing of the seat back 26 into the seat cavity 46 is continued, the seat back 26 moves with the seat bottom 25 into the seat cavity 46.

When the seat back 26 is moved from the retracted position, as shown by FIG. 7, to the extended position, as shown by FIG. 1, the movement of the seat back 26 out of the seat cavity 46 pulls the seat bottom 25 out of the seat cavity 46. As the seat bottom 25 exits the seat cavity 46, gravity pulls the seat bottom 25 toward the luggage case 17 such that the seat bottom 25 pivots about points 49, 50 away from the seat back 26. Eventually, the seat bottom 25 contacts and rests on a side of the luggage case 17, as shown by FIGS. 1 and 3.

Note that the seat bottom 25 may be spring loaded. As an example, the seat bottom 25 may be spring loaded to force the seat bottom 25 toward the luggage case 17 in an effort to keep the seat bottom 25 pressed against the luggage case 17. Alternatively, the seat bottom 25 may be spring loaded to force the seat bottom 25 toward the seat back 26. In such an embodiment, the seat bottom 25 remains pressed against the seat back 26 as the seat back 26 is moved to the extended position. To place a child 35 on the seat bottom 25, a user may grab the seat bottom 25 by hand and pivot it about the points 49, 50 toward the luggage case 17. After placing the child 35 on the seat bottom 25, the weight of the child 35 keeps the seat bottom 25 pressed against the luggage case 17. When the child 35 is removed from the seat bottom 25, the force applied by a spring (not shown) moves the seat bottom 25 toward the seat back 26 causing the seat bottom 25 to contact the seat back 26 such that the seat bottom 25 is appropriately positioned for insertion into the seat cavity 46, as described above. Other configurations of the seat back 26 and seat bottom 25 are possible in other embodiments.

In addition, it should also be noted that the use of a seat bottom 25 is unnecessary. For example, a child 35 may sit directly on the article 15 without a seat bottom 25 and lean back against the seat back 26.

Figure 9:
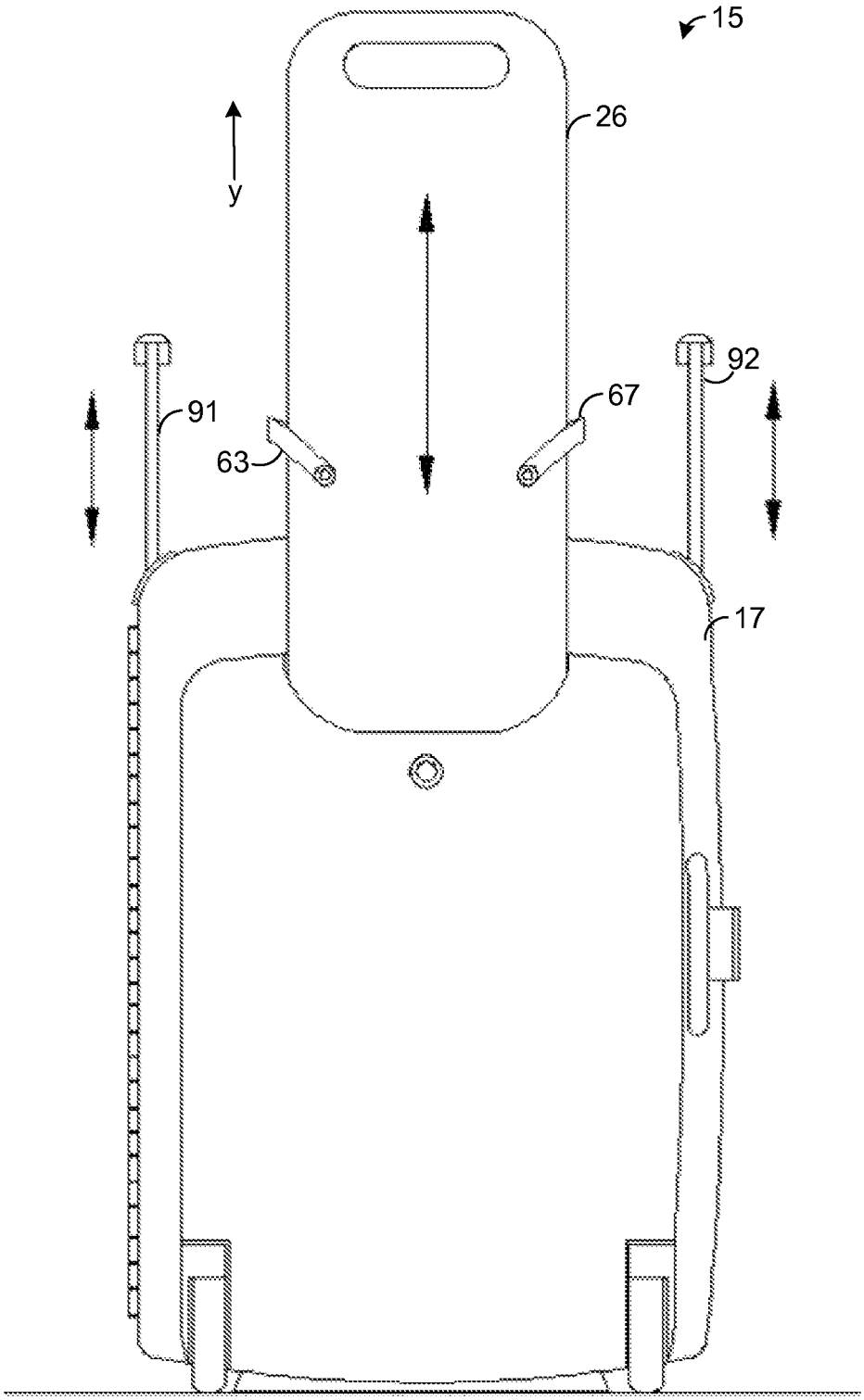
FIG. 9 depicts a front view of the article of luggage depicted in FIG. 1 after side straps of a safety harness system have been secured to the seat back.
Figure 10:
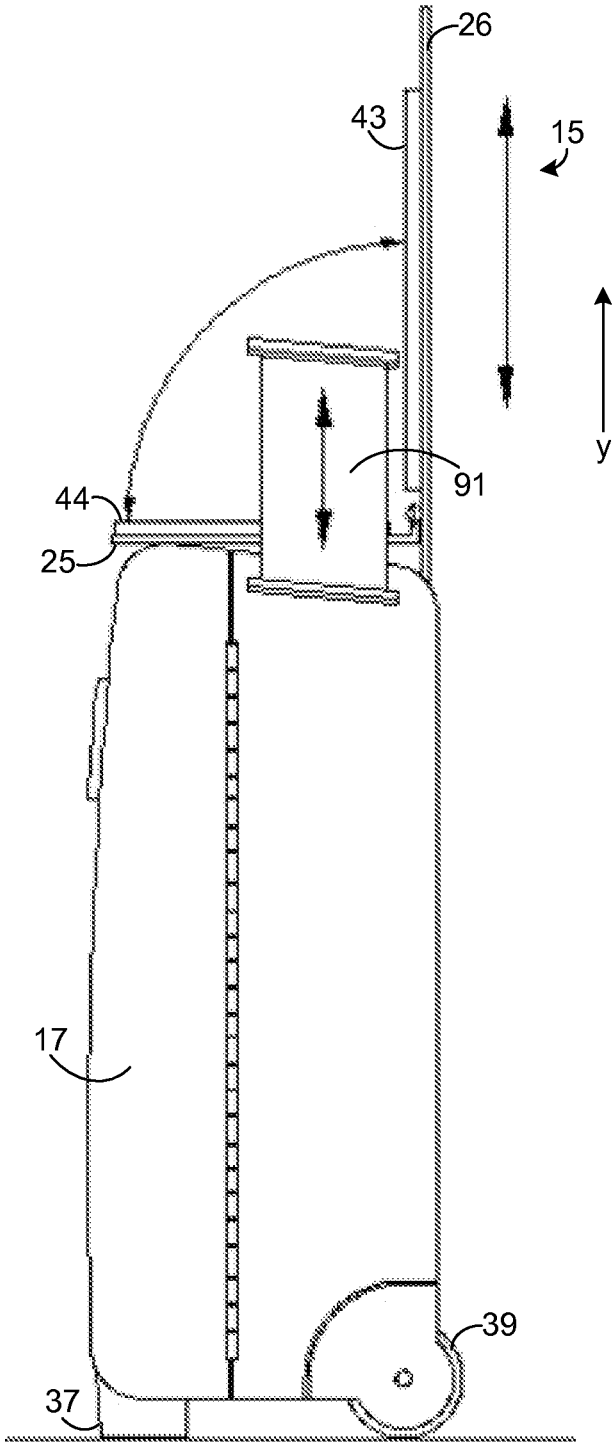
FIG. 10 depicts a side view of the article of luggage depicted in FIG. 3 after side rails have been moved to extended positions.
Figure 11:
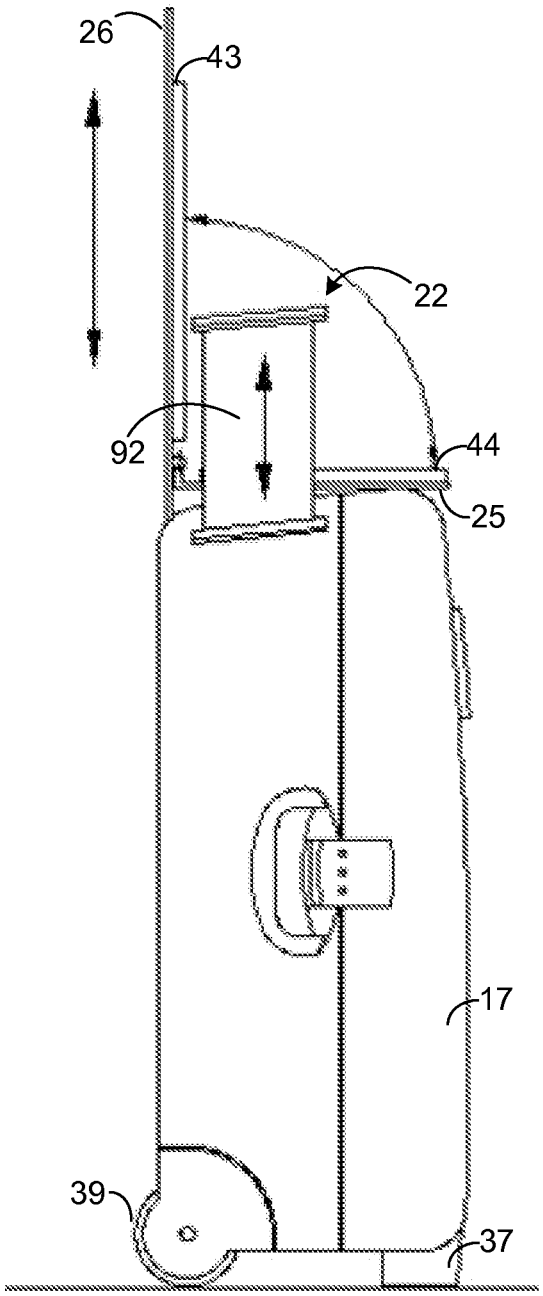
FIG. 11 depicts a view of an opposite side of the article of luggage depicted in FIG. 10.

As shown by FIG. 1, the article 15 has a safety harness system 60 for securing a child 35 sitting on the seat 22. This system 60 secures a child 35 using a crotch strap 65 and a pair of side straps 63, 64 that are sewn or otherwise joined at a point 66. The side strap 63 has an end 73 that is adapted to snugly fit in a hole 83 (FIG. 2) of the seat back 26 thereby securing the end 73 to the seat back 26, as shown by FIG. 9. The side strap 64 has an end 74 that is adapted to snugly fit in a hole 84 (FIG. 2) of the seat back 26 thereby securing the end 74 to the seat back 26, as shown by FIG. 9. When the system 60 is securing a child 35, a leg of the child 35 passes between the luggage case 17 and the side strap 73 while the side strap 73 is secured to the seat back 26, and the other leg of the child 35 passes between the luggage case 17 and the side strap 74 while the side strap 74 is secured to the seat back 26.

To facilitate removal of the child from the seat 22, the strap ends 73, 74 may be pulled to remove such ends 73, 74 from the holes 83, 84, respectively, as shown by FIG. 1. The luggage case 17 has a pocket 85, and an end of the crotch strap 65 is coupled (e.g., sewn) to the luggage case 17 within the pocket 85. If desired, the straps 63-65 may be inserted into the pocket 85 for storage when not in use to secure a child 35.

In one exemplary embodiment, the article 15 has a pair of movable side rails 91, 92, as shown by FIG. 9. The side rails 91, 92 are in a retracted position in FIG. 6 and, thus, are hidden from view. When in the retracted position, each side rail 91, 92 resides within a respective cavity, referred to herein as "rail cavity," of the luggage case 17. Each of the side rails 91, 92 is shown in an extended position in FIGS. 9-12. To move each side rail 91, 92 from its respective retracted position to its respective extended position, the side rail 91, 92 is grasped by a user and pulled in the y-direction.

In one exemplary embodiment, when a side rail 91, 92 is pulled to its respective extended position, it is locked in such position by a locking mechanism (not shown) until the locking mechanism is activated by the user to allow the side rail 91, 92 to move toward its respective retracted position. Many conventional locking mechanisms are well-known and may be used to lock either of the side rails 91, 92 in the extended position. As an example, locking mechanisms commonly used to lock retractable handles of conventional suitcases may be used to lock either of the side rails 91, 92. Further, use of a locking mechanism for either the side rails 91, 92 is unnecessary and may be omitted if desired.

In one exemplary embodiment, the seat back 26 is secured to the luggage case 17 while it is in the seat cavity 46 thereby preventing the seat back 26 from inadvertently moving toward the extended position. There are various techniques that could be used to secure the seat back 26. For example, as shown by FIG. 2, the seat back 26 has a hole 99 into which a spring loaded pin (not shown) is forced when the seat back 26 is moved to the retracted position. When the spring loaded pin is in the hole 99, movement of the seat back 26 from the retracted position is prevented. Such spring loaded pin is actuated by a release button 101. When the release button 101 is pushed or otherwise activated, the spring loaded pin is removed from the hole 99 allowing the seat back 26 to move from the retracted position. In other embodiments, other techniques for securing the seat back 26 in the retracted position are possible. In addition, securing the seat back 26 in the retracted position is unnecessary, and the use of a securing mechanism to secure the seat back 26 in the retracted position may be omitted in other embodiments.

FIG. 4 shows the article 15 in an upright position when it is not being moved by a user. As shown by FIG. 5, the article 15 may be tilted and moved (e.g., pushed or pulled). While the user is pushing or pulling the article 15 in a tilted position, the article 15 rolls on its wheels 39, which rotate relative to the luggage case 17.

In one exemplary embodiment, a locking assembly (not shown in FIGS. 4 and 5) is used to lock the wheels 39 so that rotation of the wheels 39 is prevented while the article 15 is in the upright position, as shown by FIG. 4. Such locking assembly helps to keep the article 15 stationary and reduces the likelihood that the article 15 will tip over potentially injuring the child 35. Various types of locking assemblies may be used to prevent rotation of the wheels 39 while the article 15 is in the upright position.

Figure 13:
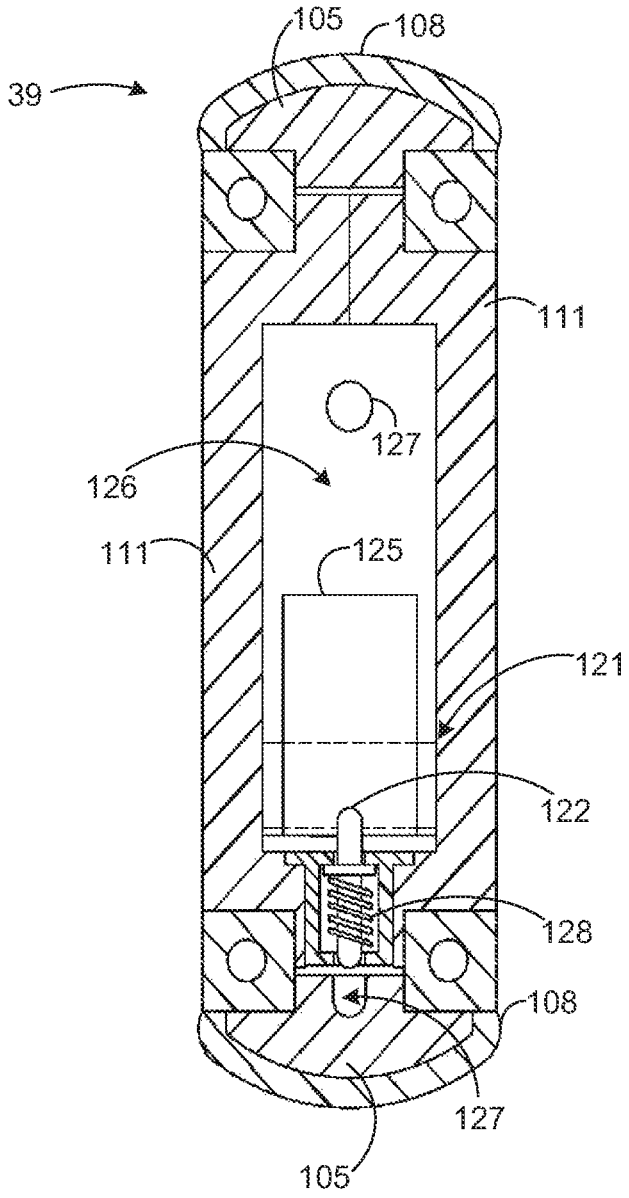
FIG. 13 depicts a cross-sectional view of a wheel of the article of luggage depicted in FIG. 1.

As shown by FIG. 13, each wheel 39 comprises an outer core 105 that is covered by a layer 108 of pliable material, such as rubber. The use of layer 108 is unnecessary and may be omitted if desired. The outer core 105 and layer 108 rotate in unison relative to the luggage case 17 as it is rolled. Within the wheel 39 is an inner core 111 that is coupled to and remains stationary relative to the luggage 17. Hence, when the article 15 is rolled, the outer core 105 and layer 108 rotate in unison about the inner core 111.

Figure 17:
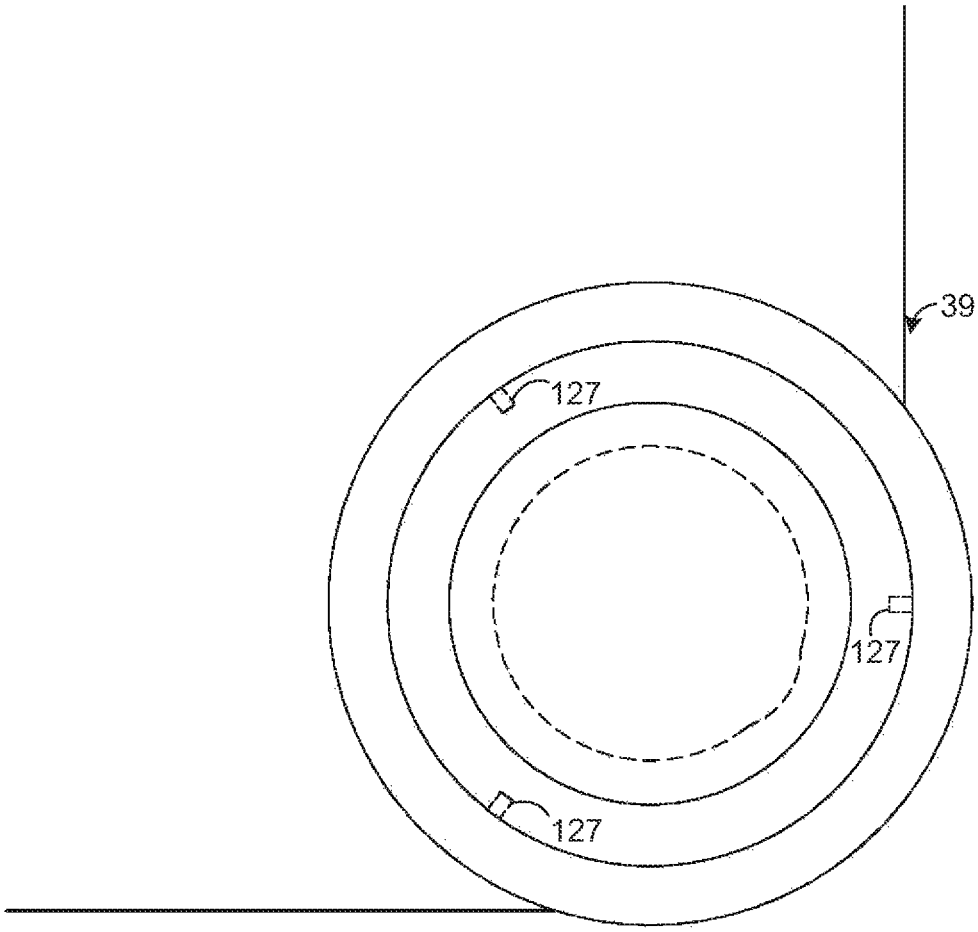
FIG. 17 is a side view of the wheel depicted in FIG. 13.

In one exemplary embodiment, a locking assembly 121 comprises a spring loaded in 122 and a ball bearing 125. The ball bearing 125 resides within a cavity 126 of the inner core 111. The pin 122 passes through the inner core 111, and the outer core 105 has a plurality of holes 127 along its inner circumference for receiving the pin 122. Exemplary hole locations are shown by FIG. 17. A spring 128 is configured to push the pin 122 toward a center of the inner core 111. However, the weight of the ball bearing 125 is sufficient to overcome the force of the spring 128.

Figure 14:
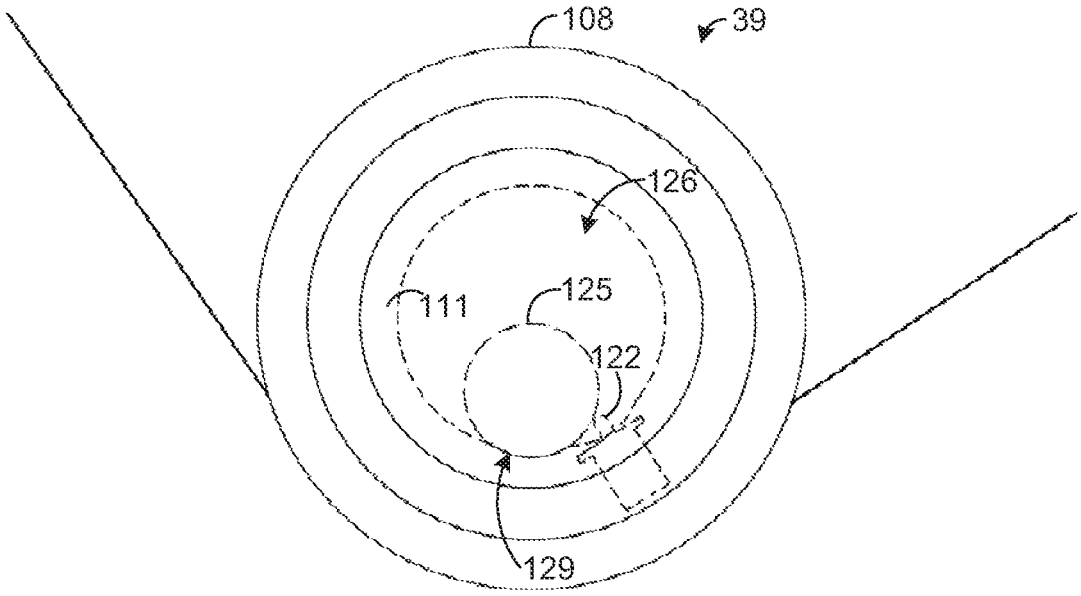
FIG. 14 depicts a side view of the wheel depicted in FIG. 13 when the article of luggage is tilted.

FIG. 14 shows the wheel 39 of FIG. 13 when the luggage case 17 is tilted and being rolled. Gravity pulls the ball bearing 125 to the lowest point of the inner core 111, and the tilting of the article 15 moves the pin 122 from this lowest point so that it is not positioned directly underneath the ball bearing 125. When the pin 122 is so positioned, the force of the spring 128 pushes the pin 122 such that a tip of the pin 122 is in the cavity 126, and a relatively small amount, if any, force is applied to the pin 122 by the ball bearing 125. In such position, the pin 122 does not impede the rotation of the wheel 39, and the wheel 39 is allowed to rotate. Note that the inner circumference of the inner core 111 has a groove 129 for helping to hold the ball bearing 125 in the shown position while the article 15 is tilted.

Figure 15:
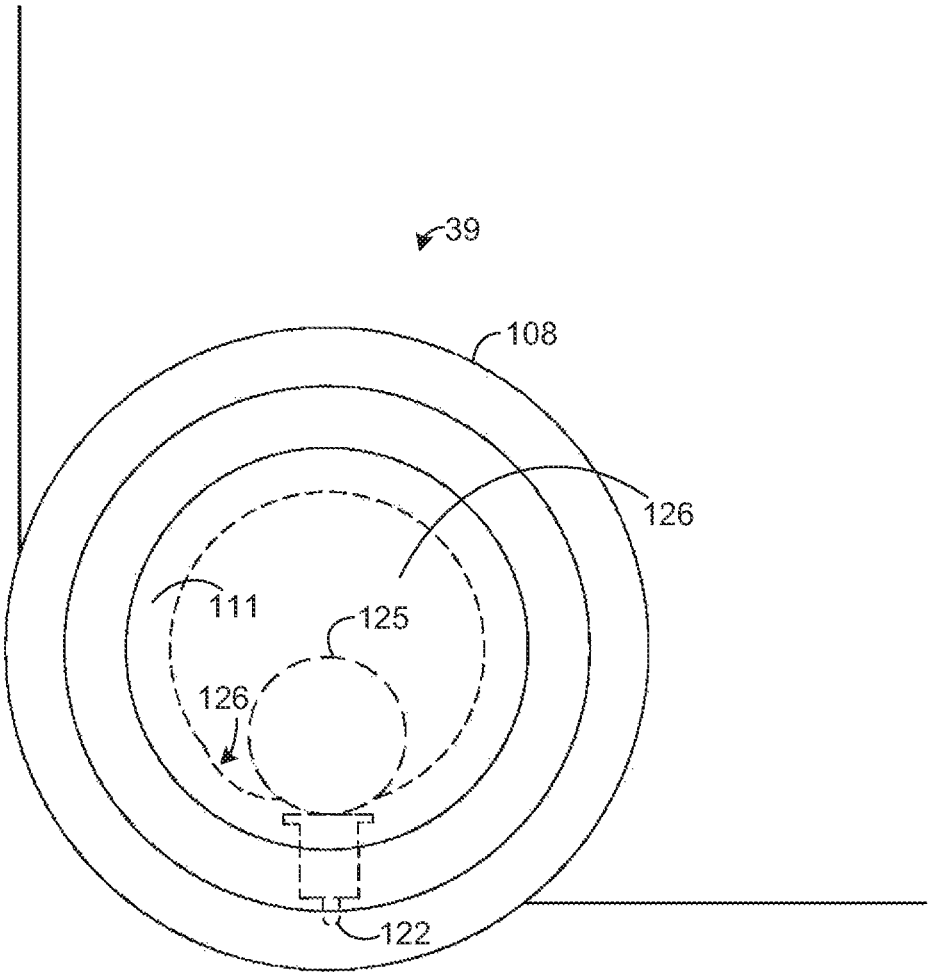
FIG. 15 depicts a side view of the wheel depicted in FIG. 13 when the article of luggage is in an upright position.

When the article 15 is moved to the upright position, such as when the user stops moving the article 15 and releases it, the pin 122 is moved to the lowest point of the inner core 111, as shown by FIG. 15. Gravity forces the ball bearing 125 toward the pin 122 causing the ball bearing 125 to exert a relatively large amount of weight on the pin 122 thereby counteracting the force applied by the spring 128. While the article 15 is in or close to the upright position, the article 15 is rolled on the wheel 39 such that the outer core 105 rotates relative to the inner core 111 until a hole 127 in the outer core 105 is aligned with the pin 122. When a hole 127 becomes so aligned, the weight of the ball bearing 125 forces the pin 122 into such hole 127. Insertion of the pin 122 into the hole 127 such that the pin 122 now extends through both the inner core 111 and the outer core 105 prevents rotation of the outer core 105 about the inner core 111. Thus, the wheel 39 is locked by the pin 122 such that it does not rotate relative to the article 15.

As described above, to unlock the wheel 39, the article 15 is tilted such that the pin 122 moves out from under the ball bearing 125, as shown by FIG. 14, reducing the force applied to the pin 122 by the ball bearing 125. Accordingly, the force from the spring 128 forces the pin out of the hole 127 in the outer core 105 thereby allowing the outer core 105 to move relative to the inner core 111. Thus, the wheel 39 may again rotate relative to the luggage case 17

An exemplary use and operation of the article 15 of luggage will be described below with particular reference to FIG. 16.

Figure 12:
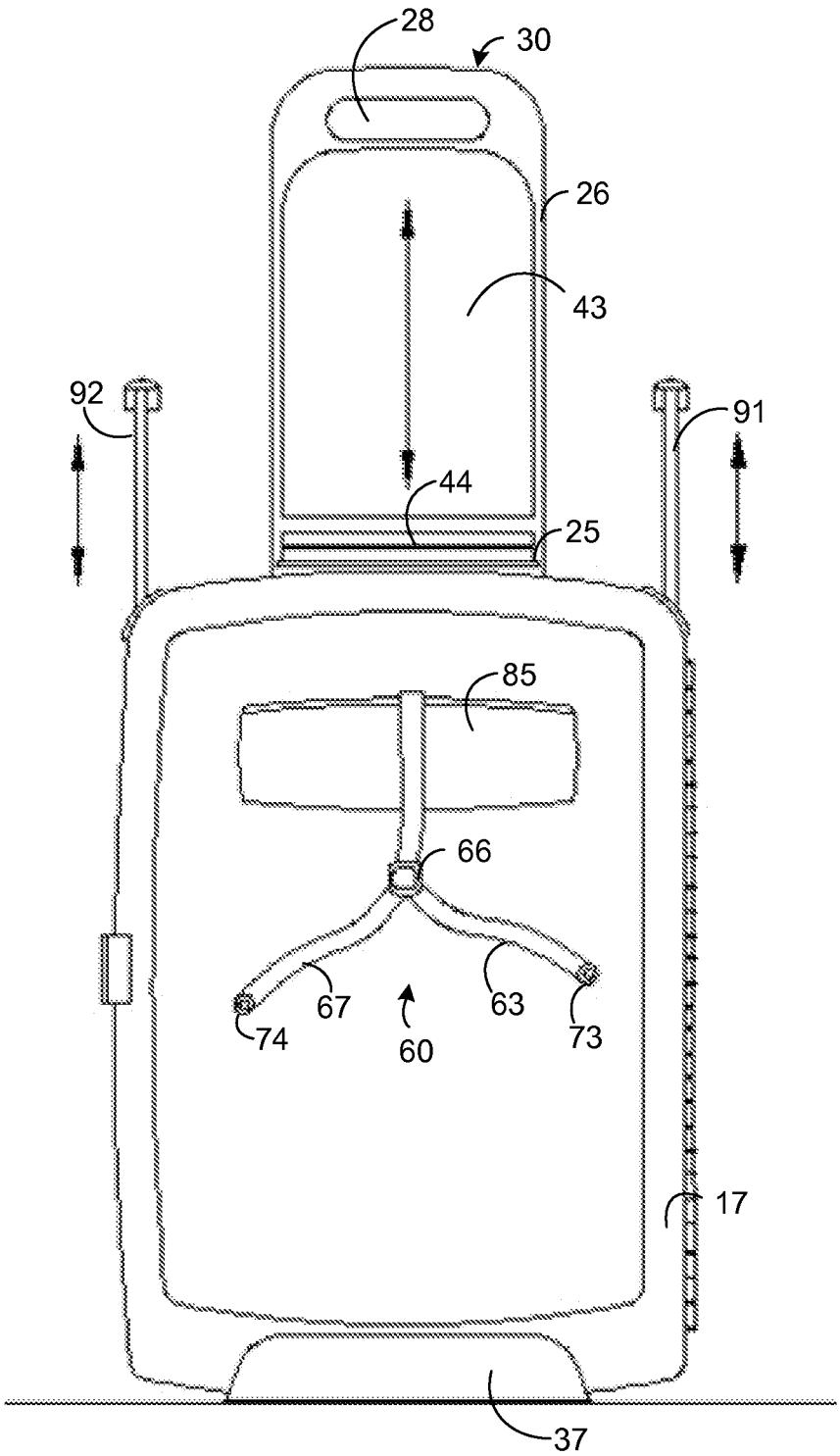
FIG. 12 depicts a front view of the article of luggage depicted by FIG. 11.

For illustrative purposes, assume that the seat back 26 and the side rails 91, 92 are in the retracted position such that the luggage article 15 appears as shown by FIGS. 6 and 7. A user pushes the release button 101 to allow movement of the seat back 26 relative to the luggage case 17. The user then grasps the handle 30 by hand and pulls the seat back 26 from the retracted position to the extended position as shown by block 203 of FIG. 16. As the seat back 26 is pulled out of the seat cavity 46, the seat bottom 25 pivots about pivot points 49, 50 such that the seat bottom 25 contacts and rests on a side of the luggage case 17 when the seat back 26 is in the extended position, as shown by FIGS. 1 and 2. The seat bottom 25 may be pulled by gravity, by hand, or otherwise in order to cause the pivoting of the seat bottom 25. The user may also pull the rails 91, 92 from their respective retracted positions to their respective extended positions, as shown by FIG. 12.

Figure 16:
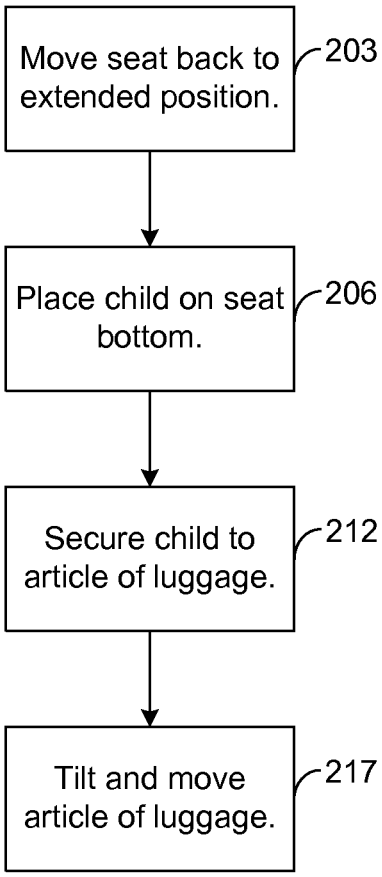
FIG. 16 is a flow chart illustrating an exemplary method of transporting a child with an article of luggage, such as is depicted by FIG. 1.

The user then places a child 35 on the seat bottom 25 such that the child's back faces and may rest against the seat back 26, as shown by block 206 of FIG. 16. The user then secures the child to the luggage article 15 by inserting strap ends 73, 74 into the holes 83, 84, respectively, as shown by block 212 of FIG. 16. The user then tilts and moves the luggage article 15, as shown by FIG. 5 and block 217 of FIG. 16. In this regard, the tilting of the article 15 causes the locking assembly 121 of each wheel 39 to unlock the respective wheel 39 so that it can rotate. Once the user stops moving the article 15, the user returns the article 15 to the upright position at which point the locking assembly 121 of each wheel 39 locks the respective wheel 39 so that it can no longer rotate.

Now, therefore, the following is claimed:

1. An article of luggage, comprising:

a luggage case having a cavity;

at least one wheel coupled to the luggage case;

a retractable seat having a seat bottom and a seat back that is coupled to the seat bottom, the retractable seat coupled to the luggage case, wherein the seat bottom is positioned such that a child sitting on the seat bottom is supported by the luggage case when the retractable seat is in a first position, the retractable seat movable from the first position to a second position such that at least a portion of the seat bottom and at least a portion of the seat back move into the cavity when the seat is moved from the first position to the second position; and a wheel lock assembly configured to lock the wheel, wherein the wheel comprises an outer core that rotates around an inner core, wherein the wheel lock assembly comprises a spring loaded pin that passes through the inner core, and wherein the wheel lock assembly has a weight for pushing the pin into the outer core to lock the wheel.

2. The article of claim 1, wherein the seat back has a pad.

3. The article of claim 1, wherein the seat bottom has a pad.

4. The article of claim 1, wherein the seat bottom is pivotally coupled to the seat back.

5. The article of claim 1, wherein movement of the seat back into the cavity generates a force that pivots the seat bottom toward the seat back.

6. The article of claim 1, further comprising a safety harness system for securing a child to the article of luggage.

7. The article of claim 1, further comprising at least one strap coupled to the luggage case and to the seat back.

8. The article of claim 1, wherein the seat bottom is spring loaded.

9. The article of claim 1, wherein gravity forces the weight onto the pin, thereby pushing the pin into the outer core, when the luggage case is moved from a tilted position to an upright position.

10. The article of claim 1, wherein the weight is positioned within a cavity of the inner core.

11. An article of luggage, comprising:

a luggage case having a cavity;

at least one wheel coupled to the luggage case, the wheel having an outer core that rotates around an inner core; and a retractable seat having a seat bottom and a seat back that is coupled to the seat bottom, the retractable seat coupled to the luggage case, wherein the seat bottom is positioned such that a child sitting on the seat bottom is supported by the luggage case when the retractable seat is in a first position, the retractable seat movable from the first position to a second position such that at least a portion of the seat bottom and at least a portion of the seat back move into the cavity when the seat is moved from the first position to the second position;

a spring loaded pin that passes through the inner core; and means for moving the pin into the outer core thereby locking the wheel.

12. The article of claim 11, wherein the means for moving comprises a ball bearing.

13. A method for transporting a child, comprising the steps of:

moving a seat back of an article of luggage from a retracted position to an extended position, wherein the article of luggage has at least one wheel;

positioning a child on a luggage case of the article of luggage such that a back of the child faces the seat back;

moving the article of luggage while the child is positioned on the luggage case such that the wheel rolls on a floor surface;

moving the article of luggage to an upright position; and locking the wheel while the article of luggage is in the upright position, wherein the wheel has an outer core that rotates around an inner core, and wherein the locking step comprises the step of moving a spring loaded pin such that the spring loaded pin passes through the inner core and the outer core.

14. The method of claim 13, wherein the seat back has a pad.

15. The method of claim 13, wherein the moving step comprises the steps of:

grasping the seat back; and applying a force to the seat back.

16. The method of claim 13, wherein the seat back has an end that forms a handle.

17. The method of claim 13, further comprising the step of moving the seat back from the extended position to the retracted position such that at least the seat bottom is fully contained within the cavity and at least a portion of the seat back moves into the cavity of the luggage case.

18. The method of claim 13, further comprising the step of securing the child to the article of luggage.

19. The method of claim 13, wherein the seat bottom is coupled to the seat back, and wherein the positioning step comprises the step of positioning the child on the seat bottom.

20. The method of claim 19, further comprising the step of pivoting the seat bottom toward the seat back.

21. The method of claim 13, wherein the seat bottom is spring loaded.

* * * * *